United States Patent [19]

Fleissner

[11] Patent Number: 4,942,719

[45] Date of Patent: Jul. 24, 1990

[54] METHOD FOR PACKING FIBROUS MATERIAL INTO BALES AND A FIBER BALE PRESS SUITABLE THEREFOR

[75] Inventor: Gerold Fleissner, Chur, Switzerland

[73] Assignee: Fleissner Machinenfabrik AG, Rebstein/Schweis, Fed. Rep. of Germany

[21] Appl. No.: 249,010

[22] Filed: Sep. 26, 1988

[30] Foreign Application Priority Data

Sep. 25, 1987 [DE] Fed. Rep. of Germany ..... 3732376

[51] Int. Cl.[5] ..... B65B 1/24; B65B 13/20; B65B 5/00

[52] U.S. Cl. ..... 53/436; 53/528; 100/240

[58] Field of Search ..... 53/436, 397, 528, 580; 100/240, 241, 246, 252, 253

[56] References Cited

U.S. PATENT DOCUMENTS

| | | | |
|---|---|---|---|
| 3,099,952 | 8/1963 | Dixon et al. | 53/528 X |
| 3,252,737 | 5/1966 | Seaton | 53/436 X |
| 3,614,849 | 10/1971 | Croucher | 53/528 X |
| 3,816,970 | 6/1974 | Van Doorn et al. | 53/528 |
| 3,962,846 | 6/1976 | Neitzel et al. | 53/528 |
| 4,318,264 | 3/1982 | Rewitzer | 53/436 |
| 4,685,391 | 8/1987 | Picker | 53/527 X |

FOREIGN PATENT DOCUMENTS

| | | | |
|---|---|---|---|
| 3634817 | 4/1988 | Fed. Rep. of Germany | 53/523 |

*Primary Examiner*—Robert L. Spruill
*Assistant Examiner*—Beth Bianca
*Attorney, Agent, or Firm*—Antonelli, Terry, Stout & Kraus

[57] ABSTRACT

The piece of packaging material (e.g. a sheet or plastic placed on the topside of the fiber material to be compacted exhibits marginal zones projecting all around, which must be detached from the press ram after the compressing step and must be placed against the bale. For the automatic detachment of the sheet from the press ram, leaf springs are fastened for this purpose at the side faces of the press ram and urge, after withdrawal of the press box casing, these marginal zones away from the press ram. Subsequently, the press box casing located there above again travels downwardly to the bale, namely only up to the top rim of the latter, during which step the marginal zones of the sheet projecting from the bale in the upward direction are uniformly brought into contact with the bale.

6 Claims, 2 Drawing Sheets

METHOD FOR PACKING FIBROUS MATERIAL INTO BALES AND A FIBER BALE PRESS SUITABLE THEREFOR

This invention relates to a process for the packaging of fibrous material into bales in a fiber baling press wherein a press box consisting of a press box casing with a detachable bottom plate is inserted, with the filled-in fibrous material, in the press; a sheet-like piece of packaging material for the topside of the bale is placed on the topside of the press box and is introduced together with a press ram into the press box casing for compacting the fibrous material; the fibrous material is compressed and the press box casing, detached from the bottom plate is pulled off the compressed material.

A process of this type has been known from DOC No. 2,911,958. Since the steel bands or the like for tying of the bale must not come into contact with the fibers, the bale is to be covered all around with packaging material prior to reinforcement. For this purpose, the press box floor as well as the press ram (later on) are covered, before the compacting step, with a piece (e.g. a sheet) of packaging material; then the bale is compressed, thereafter the press box casing, while maintaining the compacting pressure, is pulled off in the upward direction, and finally, to end the packaging step, the bale is wrapped all around with a wider piece of packaging material in a horizontal direction.

A prerequisite for satisfactory packaging is not only that the sheet of the packaging material covers the bale all around, but also that the sheet surrounds the bale without any creases so that the faces as well as the edges of the bale have a cleanly packaged appearance. In order to attain this objective, it is known from the aforementioned laid-open application to make the press ram as well as the press box bottom of a core ram and an outer ram surrounding the core ram so that,, after the compacting step, upon removal of the outer ram, the edge pieces of the sheet can be uniformly placed about the bale. This press ram structure is very expensive with respect to its production, and it also requires a number of movement processes in the fiber baling press which are rather timeconsuming and, in the final analysis, the press ram structure is also susceptible to trouble. In this regard, it is more advantageous if the bottom and the press ram are not subdivided but, rather, are made of one piece. However, in such a case, devices must be provided in the upper as well as lower press rams which after the compression step, bend the outwardly projecting edge sections of the pieces of packaging material at the bottom and at the top toward the bale. These edge sections which there as desired, are in contact with the bale, are finally covered with the horizontally wrapped-around sheet so that the tale is completely and smoothly packaged all around.

As is known from DOC No. 2,911,958, the upper press ram consists of a planar plate penetrated by wrapping grooves for the reinforcing step. Fingers are arranged on recesses of the press ram which ram, after all, must travel through the press box casing longitudinally; these fingers are to effect bending over of the edge or marginal sections of the sheet of packaging material in contact with the press ram, in the downward direction. It has been found that the marginal sections of the sheet can be placed downwardly against the bale only with difficulties by these fingers. This is due to the fact, on the one hand, that the compacted fiber material expands toward the outside when the press box casing is pulled off, and the fingers then have difficulties in outwardly seizing the compacted fiber material and, on the other hand, that the fingers, although they would be able to act on the sheet in the downward direction in the central zones of the side faces of the press ran, the fingers cannot act in this way at the corners. Time and again, it happens that precisely at the corners, the sheet forms a kind of ear in the upward direction, this ear projecting from the bale in opposition to the contacting direction. Quite apart from these difficulties, it is very expensive from a structural viewpoint to forcibly move such fingers at the press ram with the long compression cylinder.

It has now been proposed, in order to solve this problem, to fashion the press ram as a trough so that the sheet of packaging material, lying in the press ram obtains, in the marginal zones, a downwardly directed prior orientation which then has a positive effect on folding over the sheet after the pressing step in the downward direction. In connection with the press ram which, according to its function, must travel longitudinally through the press box casing, this construction is, however, not so advantageous because the press ram cannot be configured to have a cross section larger than the cross section of the press box casing, in order to prevent overflowing of the fiber material past the rim of the trough after the press box casing has been pulled off. For these reasons, shaping the press ram as a trough, by itself, is not sufficient for effecting a prior orientation of the sheeting in the downward direction.

The invention is based on the object of developing a process providing that an upper sheet of packaging material is caused to detach itself from the press ram and automatically is placed into contact with the bale, without the aid of fingers or like devices which are to be driven and which would have to be arranged in the press ram. The objective is to provide that the sheet, after pulling off the press box casing is caused to automatically contact the bale in order to avoid, in any event, that any marginal sections of the sheet project approximately perpendicularly from the bale.

Starting with the process of the above-mentioned type, the provision is made, to solve the thus-posed problem, that the sheet of packaging material placed on the press box casing on the top, the marginal sections of this material which protrude with respect to the compression surface of the press ram being bent toward the press ram, is, after withdrawing the press box casing, automatically urged away from the press ram, and then the press box casing previously pulled away, i.e., upwardly, from the bale is again moved with its bottom edge downwardly to the top edge of the fiber bale and during this step all marginal sections of the sheet of packaging material placed on top of the fiber material are folded in toward the bale. This simple solution is very effective, because such automatic urging away of the edge sections of the sheet material from the press ram is adequate for being able to affect the sheet and is effected mechanically from the top of the press ram. This mechanical folding over is effected by means which, however, do not consist in additional fingers that would have to be arranged in a planar plate of the press ram and operated from above but, rather, resides in a process step of moving the press box casing again up to the top edge of the bale, at this time only for urging the sheet of packaging material all around against the bale. In this connection, it is advantageous to have blow air in the form of air impulses act on the sheet from the top, urging the sheet additionally against the bale.

The fiber baling press which, for performing this process, advantageously needs to be supplemented only to a minor extent, exhibits each of the lateral faces of a planar plate of the press ram additional leaf springs extending to above the plate and being oriented at least partially obliquely away from the side faces of the plate in the upward direction. During the pressing step, these springs are pressed by the inner wall of the press box casing by way of the interposed sheet against the sides of the plate of the press ram. This also takes place during the step of pulling off the press box casing, until the springs exit at the bottom from the upwardly withdrawn casing, and spring open. The springs, therefore, then automatically urge the sheet of packaging material away from the ram plate of the press ram toward the outside so that subsequently the repeated downward lowering of the press box casing is sufficient to effect that the lower rim of the press box casing can seize the sheet from above all around the bale and ca turn the sheet over in the downward direction. Air impulses directed on the marginal sections of the sheet, and possibly contact plates adjusted in the direction of movement of the compacted bale into the reinforcing station are, in this arrangement, adequate for bringing about a satisfactory placement of the upper sheet all around the bale.

The drawing illustrates an embodiment of a fiber baling press; the individual steps of the process and the press according to this invention will be described in greater detail with reference thereto In the drawing.

Figure 6B:
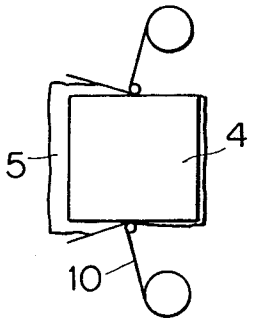
Figure 7B:
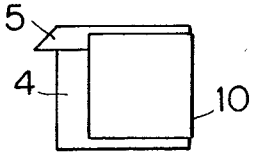
Figure 6A:
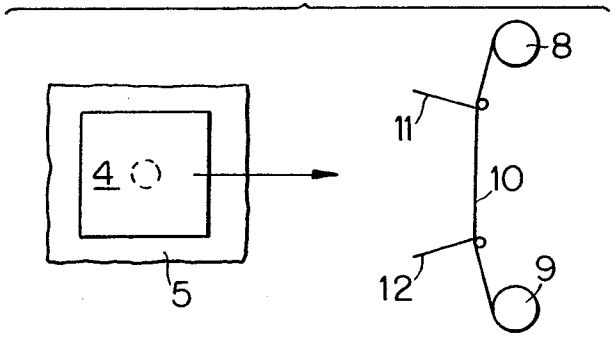
Figure 7A:
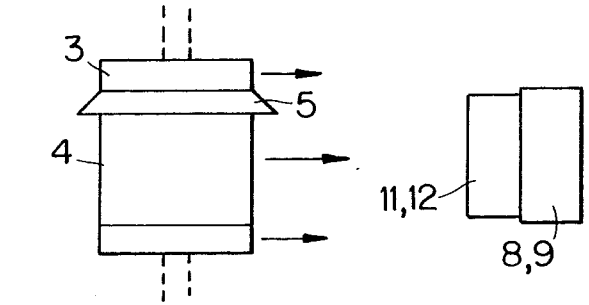

FIG. 6*a* shows schematically a top view of the press prior to being moved laterally towards the packing station;

FIG. 6*b* shows schematically a top view of the forming of a band around the bale;

FIG. 7*a* shows a side view of the arrangement shown in FIG. 6*a*; and

FIG. 7*b* shows a side view of the arrangement shown in FIG. 6*b*.

Figure 1:
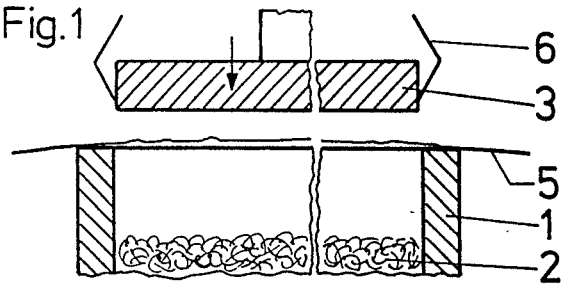
FIG. 1 shows a press box casing in the upper zone with the press ram to be lowered.
Figure 2:
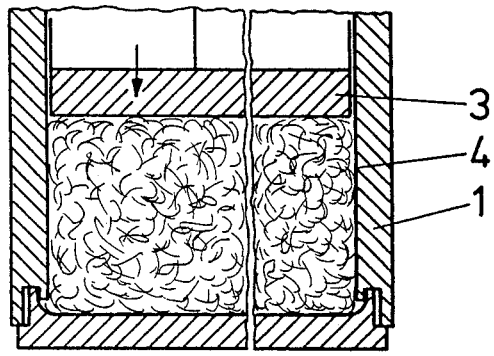
FIG. 2 shows the press box casing according to FIG. 1 in the lower zone, with the fiber bale.

FIG. 1 illustrates a situation wherein the fiber material 2, in a rough press, not shown, had been filled into a press box, of which only the press box casing 1 is visible, and then the press box casing had been moved to the main press in order to be compacted at that location by means of the planar plate 3 of the press ram. The plate 3 and associated drive shaft thus travel perpendicularly into the press box casing 1 and, with the side faces of the plate being closely adjacent to the inner walls of the casing, compacts the fiber material 2 into the bale 4 as seen from FIG. 2.

The ram plate has a lower compression surface that contacts the fibrous material and an upper surface arranged substantially in parallel to the lower surface with vertical side faces extending therebetween.

On account of the requirement to cover all of the surfaces of the bale with a packaging material, it is necessary to place, prior to compression of the fiber material, a packaging material piece 5 (e.g. a sheet of plastic material) between the fiber material 2 and the plate 3 of the press ram, this piece then being entrained during downward movement of the plate 3 into the space encompassed by the press box casing. The lower surface of the plate is thus covered with a piece of packaging material, while the marginal zones of the material are bent in the upward direction when the plate 3 moves into the press box casing 1, and thus these zones enter in between the side faces of the ram plate and the inner casing surface of the press box casing 1.

Figure 3:
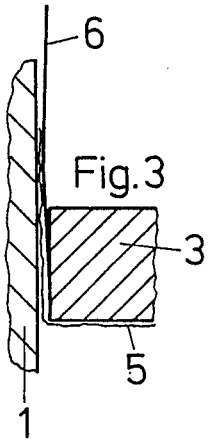
FIG. 3 shows in an enlarged view the marginal zone of the press ram according to FIG. 2 with the press ram having traveled into the press box casing.
Figure 4:
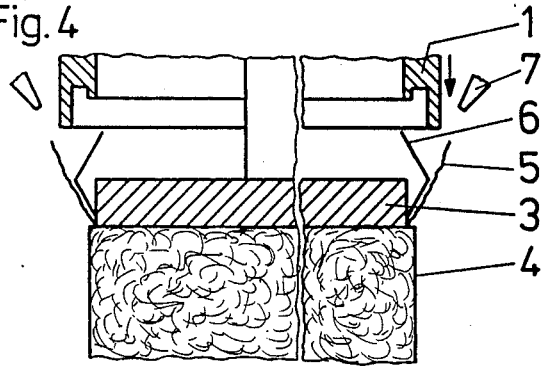
FIG. 4 shows the fiber bale according to FIG. 2, under compacting pressure, with the press box casing having been pulled off toward, the top.
Figure 5:
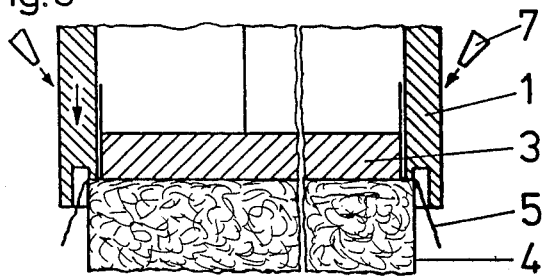
FIG. 5 shows the bale of FIG. 4, still under compacting pressure, with the press box casing again having been lowered to the top edge of the bale.

If, now, the press box casing 1, in correspondence with the illustration in FIG. 4, is pulled off in the upward direction in order to be able to also cover the side faces of the bale 4 with packaging material, then, of course, the marginal zone of the upper piece of packaging material will remain on the side faces of the ram plate 3. In order to provide that the marginal zones of the packaging material will now come into contact with the bale, these marginal zones must be seized because these zones do not drop downwards on their own; in any event this does not occur at the corners of the bale. For this purpose, leaf springs 6 are arranged all around on the side faces of the ram plate 3, these springs provide means for urging the packaging material in its marginal zones away from the press ram toward the outside as soon as the press box casing 1 has been withdrawn in the upward direction. As can be seen in detail from FIG. 3, the leaf springs 6 are attached to the ram plate 3 to be freely resilient at the side faces of the plate 3 in the upward direction so that the marginal zones of the sheet come to lie between these leaf springs 6 and the inner casing surface of the press box casing 2. This position will not be altered, either, if the press box casing is pulled off in the upward direction, but in such an event the leaf springs, in correspondence with the illustration in FIG. 4, spring open toward the outside and urge the marginal sections of the packaging material 5 toward the outside, i.e., away from the side faces.

The leaf springs are oriented, in the region of the side faces of the ram plate, obliquely away in the upward direction, and then, with a spacing with respect to the compacting surface, at a large angle are again bent toward the ram plate 3 so that such respective end of the leaf springs 6 terminates above and within the upper surface of the ram plate. In this way, there is no danger that, upon the repeated lowering of the press box casing 1, the upwardly open leaf springs 6 are bent over toward the outside; rather, the springs are automatically bent inwardly and are stretched smooth in the manner shown by the illustration in FIG. 3.

After the marginal zones of the sheet of packaging material 5 have now been urged away toward the outside from the press ram, there is no longer a problem in conveying the marginal zones downwardly, in that the press box casing 1, previously withdrawn in the upward direction, then is moved downwards in correspondence with the illustration in FIG. 4, seizing during this step the furthermore upwardly oriented marginal zones of the packaging material piece 5 and placing same all around in the downward direction against the sides of the bale. This, therefore, holds true not only for the longitudinal sides of the bale, but also for the four corners where, as is known, the danger exists that the sheet forms a kind of ear stubbornly oriented in the upward direction.

By means of air blown onto the marginal zones of the packaging material, which can also be blown in a pulsed mode from the nozzles 7 onto these marginal zones, the turning-over step is enhanced, on the one hand, but, on the other hand, a renewed righting of the packaging material is prevented as long as these marginal zones are not firmly pressed against the bale by the sheet to be wrapped around horizontally. This horizontal wrapping of the bale takes place in a conventional manner in the press of this invention by moving the bale, under compression pressure, laterally into a packaging station. During this procedure, the bale moves through a curtain of packaging sheeting which again closes after passage behind the bale, and thus the bale is covered all around with a packaging material. While moving the bale, standing under compression pressure, into the packaging station, it is advantageous to arrange plates, oriented in a funnel shape toward the bale and adjusted at a spacing having the width of a bale, in the displacement direction laterally of the bale at the level of the sheet edge sections of the packaging material arranged below the press ram, these plates then placing the possibly still somewhat protruding marginal sections against the bale in order to effect in any event an error-free packaged condition.

What is claimed is:

1. A fiber baling press comprising a press box casing defining a space therein, a vertically movable press ram having a ram plate insertable downwardly into the space encompassed by the press box casing in order to compact a fiber material which is filled within the box casing and a sheet-like piece of packaging material placed on the top side of the press box casing, and leaf springs attached to lateral surfaces of the ram plate of the press ram, said leaf springs extending above the plate and initially being oriented at least partially obliquely away from the lateral surfaces of the plate in the upward and outward directions.

2. A fiber baling pressing according to claim 1, characterized in that the leaf springs are each bent, at a spacing from a lower compression surface of the ram plate, at a large angle so that an upper portion of each spring extends toward the ram plate and the respective end of each leaf spring is located above and within the area of the upper surface of the ram plate.

3. A fiber baling press according to claim 1 with a press construction wherein the compacted fibrous material can be laterally moved, together with the press ram and the bottom plate, into a packaging station for the final packaging with sheeting of packaging material and for looping retaining straps or the like reinforcing means around the bale, characterized in that plates mutually oriented in a funnel shape and adjusted to the spacing of a width of a bale are located in the displacement direction laterally of the bale at the level of the downwardly folded over sheet edge sections of the packaging material arranged below the press ram.

4. A fiber baling press according to claim 2 with a press construction wherein the compacted fibrous material can be laterally moved, together with the press ram and the bottom plate, into a packaging station for the final packaging with sheeting of packaging material and for looping retaining straps or the like reinforcing means around the bale, characterized in that plates mutually oriented in a funnel shape and adjusted to the spacing of a width of a bale are located in the displacement direction laterally of the bale at the level of the downwardly folded over sheet edge sections of the packaging material arranged below the press ram.

5. A process for the packaging of fibrous material into a bale in an upright vertical fiber baling press, which comprises inserting a press box consisting of a press box casing with a detachable bottom plate and containing filled-in fibrous material into the baling press; placing a sheet-like piece of packaging material for the top side of the bale to be formed on the topside of the press box casing over the filled-in fibrous material; introducing a ram plate of the press ram downwardly into the press box casing to compress the fibrous material into a bale, said ram plate having lateral surfaces provided with means for urging the packaging material away from said surfaces; detaching the press box casing from the bottom plate; pulling the press box casing upwardly off of the bale of compressed fibrous material with marginal edge sections of the packaging material protruding with respect to a compression surface of the ram plate of the press ram; urging the marginal edge sections of the packaging material, after upwardly removal of the press box casing, away from the ram plate of the press ram with said means; and moving the press box casing overlying a top edge of the bale of fibrous material whereby all marginal edge sections of the piece of packaging material are folded over inwardly toward the sides of the bale.

6. A process according to claim 5, wherein the marginal edge sections of the piece of packaging material are urged away from the ram plate by leaf springs attached to lateral, surfaces of the ram plate, said leaf springs being initially oriented at least partially obliquely away from the lateral surfaces of the ram plate prior to introduction of the ram plate into the press box casing.

* * * * *